US006228180B1

(12) United States Patent
Caroli

(10) Patent No.: US 6,228,180 B1
(45) Date of Patent: May 8, 2001

(54) METHOD FOR DISPOSING OF THE WASHING LIQUID IN A MACHINE FOR WASHING ITEMS AND THE WASHING MACHINE USED TO IMPLEMENT THE METHOD

(76) Inventor: Aurelio Caroli, Via Idice, 204 - Fr. Noce di Mercatale, 40064 Ozzano Emilia (Bologna) (IT)

( * ) Notice: Subject to any disclaimer, the term of this patent is extended or adjusted under 35 U.S.C. 154(b) by 0 days.

(21) Appl. No.: 09/216,146

(22) Filed: Dec. 18, 1998

(30) Foreign Application Priority Data

Aug. 6, 1998 (EP) ..... 98830486

(51) Int. Cl.[7] ..... B08B 3/10

(52) U.S. Cl. ..... 134/10; 134/560; 134/105; 134/104.1; 8/158

(58) Field of Search ..... 134/56 D, 57 D, 134/58 D, 105, 108, 200, 201, 104.1, 10, 12; 8/158

(56) References Cited

U.S. PATENT DOCUMENTS 3,890,987 * 6/1975 Marcussen et al. .
3,918,479 * 11/1975 Perl .
4,038,103 * 7/1977 Grunewald .
4,289,713 * 9/1981 Goettl .
4,333,887 * 6/1982 Goettl .
4,782,851 * 11/1988 Malik .
4,872,466 * 10/1989 Noren .
4,971,083 11/1990 Stach et al. .
5,549,128 8/1996 Mansur .

FOREIGN PATENT DOCUMENTS 43 09 096 9/1994 (DE) .
195 06 017 10/1995 (DE) .

* cited by examiner

*Primary Examiner*—Frankie L. Stinson
(74) *Attorney, Agent, or Firm*—Fay, Sharpe, Fagan, Minnich & McKee, LLP

(57) ABSTRACT

The invention relates to a method for disposing of the washing liquid in a machine for washing items and the washing machine that implements the method. The machine comprises a chamber for washing the items, means for supporting at least one item in the washing chamber, means for storing the washing liquid, means for bringing the washing liquid into contact with the item to be washed, and means for eliminating the washing liquid from the machine. According to the method, to eliminate the washing liquid from the machine, the washing liquid is evaporated, thus reducing the volume of liquid to be eliminated.

25 Claims, 2 Drawing Sheets

METHOD FOR DISPOSING OF THE WASHING LIQUID IN A MACHINE FOR WASHING ITEMS AND THE WASHING MACHINE USED TO IMPLEMENT THE METHOD

BACKGROUND OF THE INVENTION

The present invention relates to the washing machine sector and, in particular, to the problem of disposing of the used washing liquid.

Machines for washing components, in particular metal components for industrial use, are currently known, comprising a supporting frame which defines a tank or washing chamber and a mobile lid that can be opened and closed to allow insertion of the components in the tank, support means for the components in the tank and means which spray water and detergents dissolved in said water onto the components.

In such known washing machines the water is stored in the bottom of the tank or in a separate tank and repeatedly recirculated over the components. Thus, after a given number of washing cycles, despite the presence of filters which attempt to purify the washing water, said water becomes overloaded with washing residues, such as dust, grease, metal chippings and various residues present on the components before washing. When the water contains an excessive level of residues—for example every 15–30 days—it is substituted with clean water in which fresh detergent is dissolved. The remaining waste water contains a high level of pollutants and disposing of it is problematic and expensive. Companies which carry out this type of washing must install special chemical-physical purifiers outside the facility in order to subject the waste water to costly purification processes before disposing of it in the sewer network. If they are not equipped with such purification plant, they must acquire storage tanks for the temporary storage of the waste water, which must subsequently be transported to purifiers located at a distance from the working facility. Such waste water purification operations are expensive and inconvenient.

SUMMARY OF THE INVENTION

The present invention, in accordance with claim 1, provides a method for disposing of the washing liquid in a machine for washing items, said machine comprising a chamber for washing the items, support means for at least one item in the washing chamber, means for the storage of a given volume of the washing liquid, means for bringing the washing liquid into contact with the item to be washed, and means for eliminating the washing liquid from the machine, characterized in that to eliminate the washing liquid from the machine, the liquid is at least partially evaporated, in order to reduce the volume of liquid to be eliminated.

The present invention also relates to a washing machine which implements the method according to the present invention.

The secondary claims refer to preferred embodiments.

BRIEF DESCRIPTION OF THE DRAWINGS

Further characteristics and advantages of the invention are apparent from the detailed description which follows, with reference to the accompanying drawings, which illustrate preferred embodiments invention without restricting the scope of the invention and in which.

DESCRIPTION OF THE PREFERRED EMBODIMENTS

Figure 1:
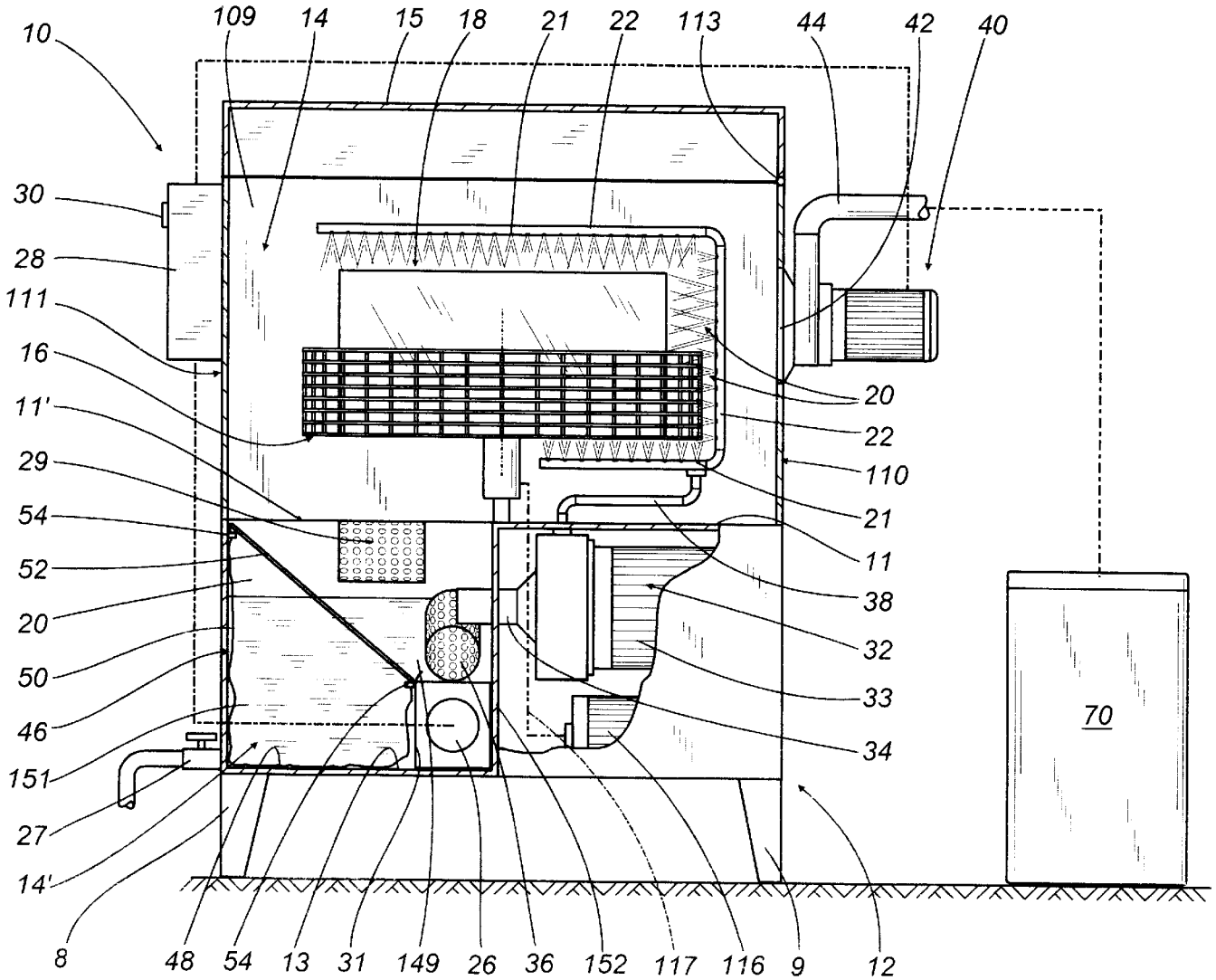
FIG. 1 is a schematic cross-section of a first preferred embodiment of the washing machine which implements the method according to the present invention.

FIG. 1 illustrates a first preferred embodiment of the machine according to the present invention. The machine 10 for washing items comprises a supporting frame 12, with feet 8, 9 which rest on the floor, defining a chamber 14 in which the items to be washed are housed by means of outer side walls, only walls 109, 110 and 111 illustrated in FIG. 1, a base wall 11 and a mobile upper wall 15, defining a mobile lid, hinged to the wall 110 at 113.

The washing machine 10 also comprises means which support at least one item 18, in the form of a basket or support surface 16 located within the washing chamber 14 and rotated by a suitable motor 116 by means of a suitable transmission system, schematically illustrated using dashes and dots and labeled 117 in FIG. 1.

In the washing machine disclosed, the washing liquid (labeled with the numeral 20) is stored in a lower compartment or tank 14' in the chamber 14, and to bring the washing liquid into contact with the item to be washed, spray nozzles 21 are envisaged on the pipes 22, located around the support for the item 18 to be washed. In a further embodiment, the item to be washed may be brought into contact with the liquid by immersing it directly in the latter rather than using a spray system.

In the machine disclosed, the washing liquid, preferably water and detergent and any other washing agents, is recirculated several times over the items to be washed and is used in several washing cycles to wash different components. After a given number of washing cycles, when the liquid is too dirty due to residues removed from the components washed—said residues, for example, comprising various substances present on the components, such as greasy or oily substances, dust, metal chippings and other substances—the used washing water is eliminated from the machine and substituted with fresh, clean washing water.

According to the present invention, to allow the washing liquid to be eliminated from the machine 10, means 26 are envisaged for evaporating, at least partially, said washing liquid 20, so as to at least partially reduce the quantity or volume of liquid to be removed from the chamber, for example, through the lower tap 27.

Said means for evaporating the liquid are a heating element 26 which heats the liquid and can also be used at a lower operating temperature to heat the liquid during the normal component washing stages. Means for evaporating the washing liquid other than the electrical heating element may also be used for the present invention.

The present machine also comprises suitable means for controlling said means 26 which evaporate the washing liquid, comprising a control unit 28 electrically connected to the heating element 26 and a control knob 30 which allows said evaporation stage to be started.

In accordance with a preferred control method, the means 26 for evaporating the washing liquid 20 are left on at least until all of the washing liquid has substantially evaporated.

To implement the preferred method, the control knob 30 can be used to start the evaporation stage, for example, at night, outside of normal working hours, and the heating element left on until the start of the next shift.

In this case, the heating element is of the type which operates without causing any damage, even when the chamber is empty, that is to say, in the absence of water to be heated. This guarantees the almost total elimination of the washing water and a "dry" residue with greatly reduced volume is obtained, allowing easy treatment of the residues.

As indicated, the storage compartment 14' for the washing liquid extends below the washing chamber 14 and has a base wall 13 and outer side walls, of which only walls 149, 151, 152 are illustrated in FIG. 1.

The top of said compartment 14' opens into the chamber 14, from which it is separated by a removable wall or panel 11' with a central trap filter 29 through which the liquid 20 sprayed onto the item descends into the compartment 14'.

The present machine also comprises means 32 for recirculating the liquid 20 from the storage compartment 14' to the sprayers 21, said means comprising a recirculating pump 33 with an intake pipe 34 whose inlet, fitted with a filter 36, is located in the lower compartment 14' which stores the washing liquid, and a delivery pipe 38 directly connected to the pipes 22 of the sprayers 21.

Moreover, as indicated, in order to completely evaporate the used washing liquid, the liquid evaporation means 26 are located close to the base 13 of said lower liquid storage compartment 14'.

To improve the evaporation cycle, means 40 are envisaged to allow the discharge of the vapor produced by the evaporation of the washing liquid 20 within the chamber 14.

Said means for the discharge of the washing liquid 20 vapor take the form of a centrifugal extractor 40 which draws the vapor through an opening 42 in the side wall 110 of the chamber 14 and, through a pipe 44, which may be fitted with filters for the vapor, directs it to the outside of the building in which the machine is installed. The vapor extracted by the extractor could also be condensed in a separate condensation tank 70, as illustrated in FIG. 1.

As indicated, the extractor means for the vapor produced are advantageously activated and controlled by the means 28 and 30 which control the heating element 26.

According to the present embodiment means 46 are also envisaged for collecting and supporting the solid or pasty residue which remains after the washing liquid has evaporated.

Said means 46 for collection of the residue are a bag whose lower part 48 is at the base 13 of the liquid storage compartment 14'. The side 50 of the residue collection bag extends over at least part of the side walls of the compartment 14'.

The collection bag 46 extends alongside the heating means 26, which are covered by a protective cage 31 to prevent contact with the bag 46.

In order to allow the liquid to make contact with the heating element 26, the bag 46 is made of a material which is permeable or porous, allowing the passage of the washing liquid, for example a fabric such as cotton or others, designed to filter the liquid.

As indicated, the inlet 36 of the washing liquid recirculating means is located above the collection means 46.

The bag 46 can be extracted or removed from the machine, so that it can be substituted with a new bag for the residues.

Means for supporting the collection means 46 are envisaged, in the form of a quadrangular bracket 52 which, thanks to projections 54 can be attached to or removed from the lower compartment 14' inside the chamber 14. The bag 46 is fixed to the bracket 52 in such a way that it may be removed, allowing easy substitution.

The bag is removed by the operator, who reaches through the upper opening, of the chamber normally closed with the lid 15, and, after removing the mobile base wall 11', lifts the bracket 52 with the solid residues held inside the bag 48.

Figure 2:
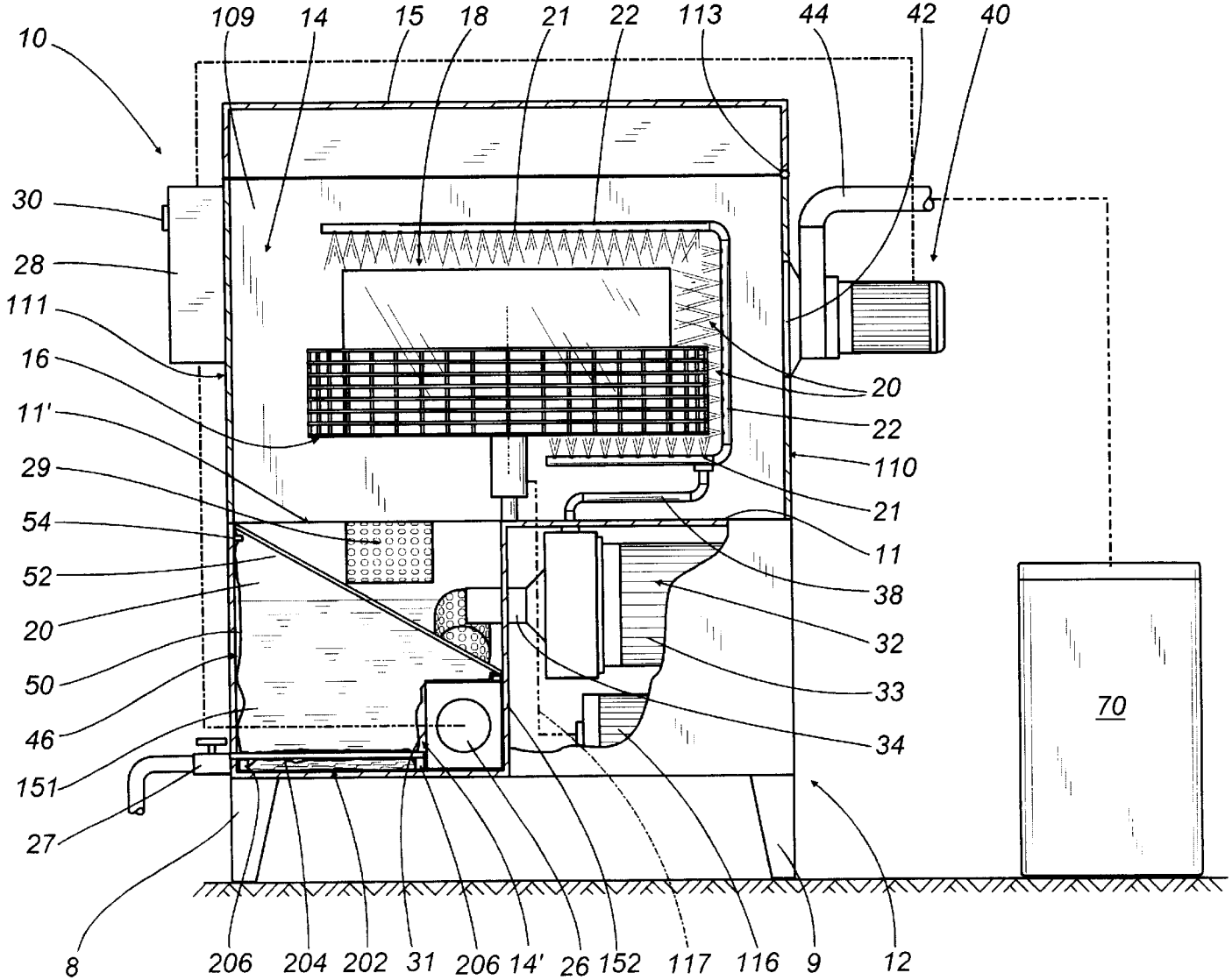
FIG. 2 is a schematic cross-section of a second preferred embodiment of the washing machine which implements the method according to the present invention.

FIG. 2 illustrates a second preferred embodiment of the washing machine according to the present invention. In FIG. 2, illustrating the second preferred embodiment of the machine, the elements similar to those in the first preferred embodiment are labeled using the same numerals as in the previous figure and, so that the present description is not too lengthy, are not described again.

The second preferred embodiment differs from the first preferred embodiment in that, at the base 13 of the compartment 14', below said first means 46 for collection of the residues, there are second means 202 for collection of the residues, which pass across said first collection means 46.

Said second collection means are a bag 202, made of a plastic material impermeable to the liquid, supported by a quadrangular supporting bracket 204 which can be attached to projections 206 substantially at the base 13 of the compartment 14' and can be detached from said projections to allow the removal and substitution of the plastic bag 202 following removal of the upper bag 46.

The second preferred embodiment also envisages that the part 50 of the porous bag 46 extends completely above the protective cage 31 over the heating element 26.

In the preferred embodiments illustrated, the washing chamber 14 is quadrangular in shape and the compartment or tank 14' is also quadrangular, although shorter, leaving a lateral space below the chamber 14 so that the various means used to drive the machine can be housed there. However, the compartment 14' could have a different shape to the quadrangular shape illustrated, for example, cylindrical, conical, or other shapes.

The machine referred to in the present invention is preferably used to wash metal components for industrial use. However, it could be adapted to make it suitable for washing any type of item, such as pans, crockery, fabrics and others.

The washing machine could also use and evaporate solvent washing liquids other than the water described herein.

What is claimed:

1. A method for disposing of washing liquid in a machine for washing items, the machine comprising a chamber for washing the items, means for supporting at least one item in the washing chamber, means for storing a given volume of washing liquid, means for bringing the washing liquid into contact with the item to be washed, and means for eliminating the washing liquid from the machine, the method being characterized in that to eliminate the washing liquid from the machine, said washing liquid is at least partially evaporated, thus reducing the volume of the liquid to be eliminated.

2. The method according to claim 1, wherein the evaporation of the washing liquid is continued until all of the washing liquid has substantially evaporated.

3. The method according to claim 1, wherein the evaporation of the washing liquid is effected after the machine has completed a preset number of washing cycles.

4. The method according to claim 1, wherein, during the evaporation stage, the vapor produced by the evaporation of the washing liquid is discharged from the washing chamber.

5. The method according to claim 2, wherein the residue obtained following evaporation of the washing liquid is removed, using removable means for the collection of the residues envisaged on the machine.

6. A machine for washing items, the machine comprising a chamber which houses the items to be washed, means for supporting at least one item in the washing chamber, means for storing a given volume of washing liquid, means for bringing the washing liquid into contact with the item to be washed, the machine being characterized in that to allow the elimination of the washing liquid from the machine, there are means which at least partially evaporate the washing liquid, reducing the volume of the liquid to be eliminated.

7. The machine according to claim 6, wherein means are envisaged to control the means for evaporating the washing liquid, said control means activating the means for evaporating the washing liquid at least until all of the washing liquid has substantially evaporated.

8. The machine according to claim 6, wherein the means for evaporating the liquid are heating means.

9. The machine according to claim 8, characterized in that the heating means consist of at least one electrical heating element.

10. The machine according to claim 6, wherein the means for storing the washing liquid comprise a storage compartment for the washing liquid, said compartment being created below the washing chamber.

11. The machine according to claim 6, wherein the means for evaporating the liquid are envisaged at the base of the storage compartment for the liquid.

12. The machine according to claim 6, wherein the means for bringing the washing liquid into contact with the item to be washed comprise means for recirculating the liquid from the storage compartment, said means having the inlet for the washing liquid in the lower compartment which houses the washing liquid.

13. The machine according to claim 6, further comprising a mobile lid for closing the washing chamber and means for discharging the vapor produced by the evaporation of the washing liquid present in the washing chamber.

14. The machine according to claim 13, wherein the means for discharging the vapor produced by the evaporation of the washing liquid are extractor means, said means extracting the vapor through an opening in a wall of the chamber.

15. The machine according to claim 6, further comprising means for collecting and supporting the residue obtained following evaporation of the washing liquid.

16. The machine according to claim 15, wherein the means for collecting the residues are means which can be removed from the machine.

17. The machine according to claim 16, wherein the collection means are envisaged at the base of the liquid storage compartment.

18. The machine according to claim 17, wherein the means for collecting the residues extend over at least part of the side walls of the compartment and/or chamber.

19. The machine according to claim 15, wherein the collection means consist of a bag made of a porous filtering material, allowing the passage of the washing liquid.

20. The machine according to claim 15, wherein the collection means are located above the heating means.

21. The machine according to claim 15, wherein the inlet of the washing liquid recirculating means is located above the collection means.

22. The machine according to claim 21, further comprising means for supporting the collection means, it being possible to attach said support means to the inside of the chamber at the lower compartment for storage of the washing liquid.

23. The machine according to claim 15, further comprising second means for collecting the residues, said second means passing across the first collection means at the base of the compartment for collection of the washing liquid, below said first means for collecting the residues.

24. The machine according to claim 23, wherein the second collection means consist a bag made of an impermeable material.

25. The machine according to claim 24, wherein the second collection means are supported by support means, it being possible to attach the support means to and detach them from the compartment substantially at the base of the latter.

* * * * *